United States Patent [19]

Stephens, Jr. et al.

[11] 4,039,324

[45] Aug. 2, 1977

[54] FLUIDIZED HYDROGEN REDUCTION PROCESS FOR THE RECOVERY OF COPPER

[75] Inventors: Frank M. Stephens, Jr., Lakewood; James C. Blair, Wheat Ridge, both of Colo.

[73] Assignee: Cyprus Metallurgical Processes Corporation, Los Angeles, Calif.

[21] Appl. No.: 631,832

[22] Filed: Nov. 14, 1975

[51] Int. Cl.[2] ..... C22B 15/00

[52] U.S. Cl. ..... 75/72; 75/26

[58] Field of Search ..... 75/72, 26, 0.5 B, 91

[56] References Cited

U.S. PATENT DOCUMENTS

| | | | |
|---|---|---|---|
| 2,758,021 | 8/1956 | Drapeau, Jr. et al. | 75/26 X |
| 2,783,141 | 2/1957 | Foley | 75/26 |
| 3,918,962 | 11/1975 | Dubeck et al. | 75/.5 B |

*Primary Examiner*—M. J. Andrews

[57] ABSTRACT

Copper is recovered from copper salts, e.g. cuprous chloride, by means of a process comprising reducing the copper salts with hydrogen in a fluidized bed in the presence of chemically inert, generally spherical, relatively smooth, non-porous particles in order to restrain sintering of the reduced copper.

17 Claims, 1 Drawing Figure

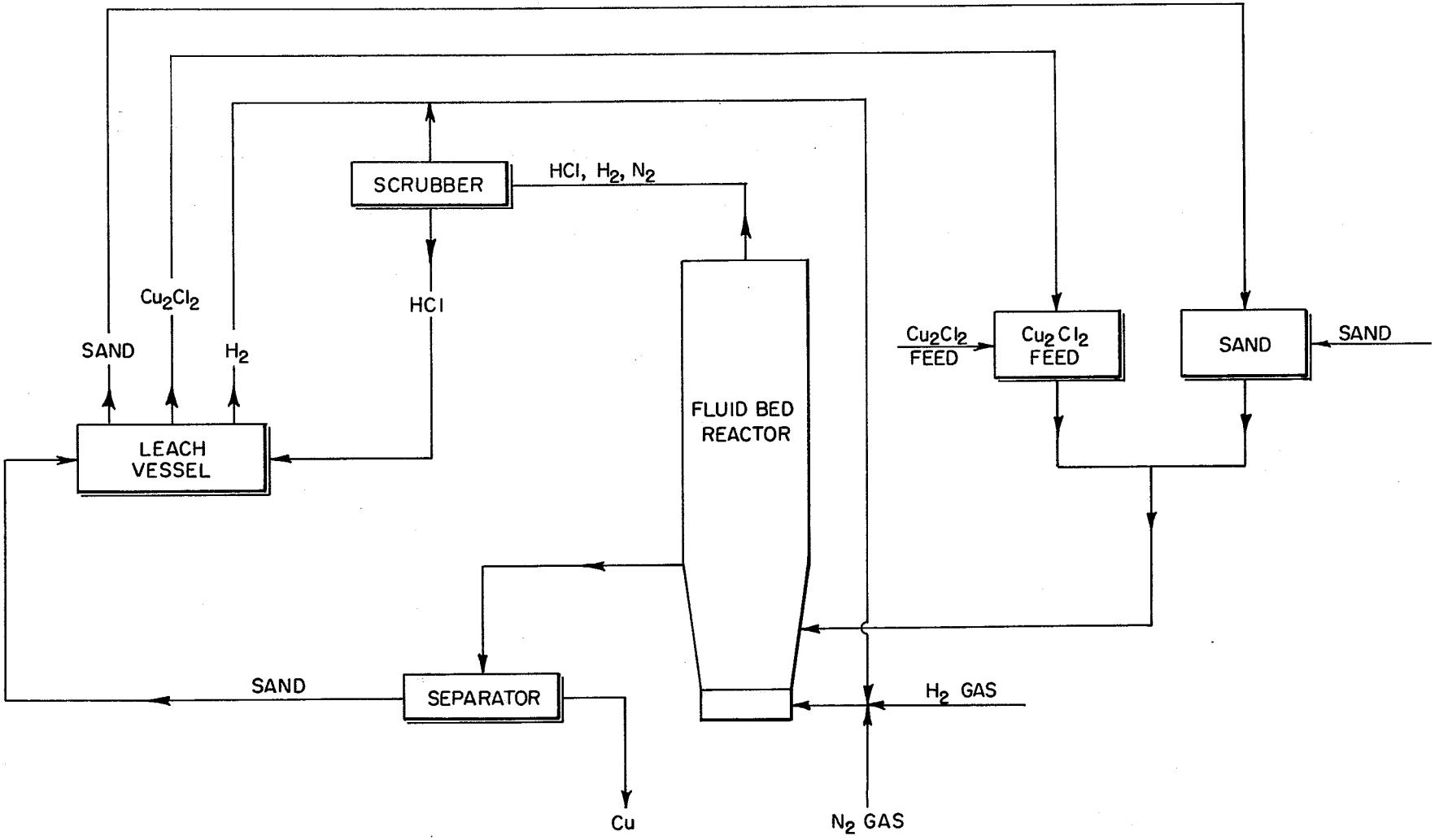
SAND
SAND
$Cu_2Cl_2$ FEED
$Cu_2Cl_2$ FEED
$H_2$ GAS
$N_2$ GAS
FLUID BED REACTOR
HCl, $H_2$, $N_2$
SCRUBBER
HCl
SEPARATOR
Cu
SAND
$H_2$
$Cu_2Cl_2$
SAND
LEACH VESSEL

FLUIDIZED HYDROGEN REDUCTION PROCESS FOR THE RECOVERY OF COPPER

BACKGROUND OF THE INVENTION

1. Field of the Invention

This invention is concerned with improved processes for recovering copper from copper salts by means of hydrogen reduction in a fluidized bed.

2. The Prior Art

Many processes are of record relating to the recovery of metals by means of fluidized bed hydrogen reduction, including a number dealing specifically with copper. For example, U.S. Pat. No. 1,671,003 to Baghdasarian discloses a process of extracting copper (and other metals) from its sulfide by chlorinating the ore to produce a copper chloride, and reducing the copper chloride to elemental copper by hydrogen reduction. U.S. Pat. Nos. 3,251,684 and 3,552,498 are additional examples of patents which employ hydrogen reduction to reduce copper cations to their elemental state.

A common technique for reducing metals to their elemental state by means of hydrogen reduction is to perform the hydrogen reduction in a fluidized bed. Numerous patents recite various techniques and apparati for conducting fluidized bed operations, including U.S. Pat. Nos. 2,529,366, 2,638,414 and 2,853,361. However, despite these numerous teachings a detrimental phenomenon has been observed in the fluidized bed reduction of cuprous chloride to elemental copper. Within certain processing parameters, the reduced copper tends to sinter and agglomerate, resulting in disruption of the fluidized state of the bed. This phenomenon has not been recognized in the prior art, although Gransden and Sheasby observed a similar phenomenon with respect to the fluidized reduction of iron in their article entitled "The Sticking of Iron Ore During Reduction by Hydrogen in a Fluidized Bed", published in the *Canadian Metallurgical Quarterly,* Vol. 13, No. 4 (1974). This article discloses that sticking of particles in the fluidized bed reduction of iron ore at temperatures in excess of 600° C occurs whenever clean iron surfaces impinge. As the temperature of reduction increases, the tendency for iron nucleation also increases. The authors discovered that coating the iron ore particles with a silica film inhibits the iron nucleation and permits iron ore reduction up to temperatures approximately 840° C.

While this solution may be feasible under some circumstances, applicants have discovered a process for preventing sintering of the reduced copper without the necessity of any surface coatings.

SUMMARY OF THE INVENTION

The reduction of copper salts to elemental copper by means of hydrogen reduction in a fluidized bed is facilitated by performing the reduction in the presence of sufficient inert particles in order to restrain sintering of the reduced copper. The particles are preferably chemically inert, range in size from about −6 to about −100 mesh at space velocities of about 1 to 5 feet per second, and within this range are relatively generally spherical and non-porous and possess relatively smooth surfaces.

DESCRIPTION OF THE PREFERRED EMBODIMENTS

The process of the present invention is useful in the fluidized bed reduction of copper values which tend to agglomerate or sinter upon reduction. These copper values include the copper oxides and copper salts, particularly including cupric chloride and cuprous chloride.

The types of fluidized bed processes employed with this invention are dependent upon engineering preference. Numerous patents and articles exist describing the various available fluidized bed processes, and the many which would be suitable for use with this invention will be apparent to the artisan. A good general discussion of such processes is provided in Perry, *Chemical Engineers' Handbook,* Fourth Edition, pages 20–42 to 20–52.

Similarly, the apparati employed with the process of the present invention is a matter of engineering design dependent upon the particular elements being processed, the fluidizing agent, and other factors known to those skilled in the art. Again, the article cited above from Perry's *Chemical Engineers' Handbook,* and the references cited therein, discuss generally the various pieces of equipment available for fluidized bed processes.

The fluidizing agent for the reactor comprises the reducing gas, hydrogen, along with sufficient inert gas, such as nitrogen, to maintain the bed in a fluidized state. The amount of hydrogen required is dependent upon the desired reaction. For the reduction of cuprous chloride hydrogen is employed in the stoichiometric amount required by the following equation:

$$Cu_2Cl_2 + H_2 \rightleftarrows 2Cu + 2HCl$$

Excess hydrogen is preferably employed to insure the complete reduction of the cuprous chloride, the amount being in conformance with thermodynamic equilibrium.

The velocity of the fluidized gas is dependent upon the overall processing conditions, and is such as to maintain the bed in a proper fluidized state. The fluidizing gas may be sufficiently preheated in order to maintain the desired reaction temperature.

The primary novelty of the present invention is the utilization of inert particles in the fluidized bed in order to control the agglomeration or sintering of the metal being produced. Uncontrolled agglomeration will tend to defluidize the bed and disrupt the process. It is therefore imperative for a successful fluidized bed process to prevent excessive agglomeration and subsequent defluidization. This problem is prevented by the present process by employing a sufficient amount of inert particles to physically prevent agglomeration to the degree that defluidization results.

The particles used for this process are preferably chemically inert with respect to the reactants in the fluidized bed reactor. Adverse chemical reactions would obviously be detrimental to the process, as well as consume the particles necessary to maintain the fluidization.

Additionally, the particles useful for this process preferably possess relatively small surface areas, and are therefore preferably generally spherical. It is observed that as the surface area of the particles increases, the tendency of the reduced metal values to cake onto the particles increases.

Furthermore, it is apparent that the particles must have a melting point in excess of the reduction temperature.

In addition to these characteristics, it is highly preferable for the particles to possess a minimum amount of surface imperfection. It is observed that surface imperfections, i.e., cracks, sharp edges, indentations, ridges left from chips, pockets, scars, cavities and the like, provide the copper values with locations upon which they tend to reduce. Additional copper values tend to collect in these areas and on the reduced copper surfaces, and ultimately the particle becomes wholly or partially coated with copper. This obviously negates the usefulness of the particle. In this same vein, the particles preferably have relatively low "apparent" porosity, "apparent" referring to the volume of open-pore space per unit total volume as opposed to sealed pore space.

It is to be understood that these preferred properties of the particles, e.g. their being chemically inert, generally spherical, and relatively smooth and non-porous, to a certain extent are relative and must be considered as a matter of degree. In other words, a certain type of particle may be completely chemically inert and non-porous but may be of a configuration not generally spherical. The use of such a particle will produce a noteworthy improvement as compared to using no particles at all to maintain fluidization in the same reaction, but would not prove to be as effective as a particle possessing all three of these qualities. Likewise, a particle may possess some degree of porosity and/or some chemical activity and still prove to be somewhat advantageous in maintaining a fluidized bed and permitting the desired reaction to proceed, but again such a particle would not be as effective as a particle possessing all three of the desired qualities.

Additional qualities of acceptable particles include the ability to be separated from the product mixtures upon completion of the process, cost of the particles, and the ability to recycle spent particles with little or no regeneration processing.

With these various considerations in mind, it has been observed that the type of particles most preferred for use with the process of the present invention is sand. Sand is chemically inert to the copper reduction processes, non-porous, has a high melting point, and many naturally occurring sand beds comprise generally spherical particles. Sand is relatively inexpensive and is easily separated from the metal products and recycled to the initial stages of the process.

Other types of acceptable particles include various ceramic and porcelain products. These products are chemically inert, non-porous and can be produced with a spherical configuration. Most possess high melting points and can be easily separated from the product mixture.

Examples of particles which are somewhat less effective than the above-set forth types, but which nevertheless produce improvement in the reduction reactions include fused magnesium oxide, aluminum oxide and fused aluminum oxide. Fused magnesium oxide is generally of low porosity and is chemically inert, but possesses rough surfaces which tend to adsorb the reduced copper, thereby causing some sintering of the reduced metal. The fused aluminum oxide produces a result similar to the fused magesium oxide. Aluminum oxide is chemically inert and generally spherical, but overly porous. This type of particle therefore adsorbs an inordinate amount of the reduced copper product.

The size of the particles useful with the present invention is dependent on several factors, including the particle density and primarily the space velocity within the reactor. It is sufficient that the particles be sized such that the bed may be maintained between incipient fluidization and entrainment. The following table provides maximum, minimum and preferred particle sizes for sand for the given space velocities:

| Space Velocity (ft./sec.) | Maximum Particle Size (Mesh) | Minimum Particle Size (Mesh) | Preferred Size Range (Mesh) |
|---|---|---|---|
| 1 | 24 | 150 | −35+65 |
| 2.5 | 16 | 65 | −20+35 |
| 5 | 9 | 48 | −14+28 |

The amount of particles employed with the product feed is dependent upon the particle size and density and generally is preferably from about 0.7 to about 10, more preferably from about 1 to 5, and most preferably from about 2 to about 3 times the weight of the copper feed material.

The term "restrained sintering" as used throughout the specification and claims herein is intended to mean the preventing of the agglomeration of the reduced product to such a degree that defluidization of the bed results. Some agglomeration of the reduced metal values is required, as the product must assume some solid form. However, the copper values to which the process of the present invention applies would, if unrestrained, agglomerate to such a degree that the bed could not be maintained in a fluidized state. The actual size to which the particles may be permitted to grow is dependent upon the particular design of the equipment and the processing characteristics of the particular bed process.

Upon completion of the fluidized bed reaction, the solid products and particles are removed and further processed in order to separate the particles from the reduced metal. Much of the product may be separated from the particles by means of screening due to the fact that the product agglomerates will be slightly larger than the inert particles. Additionally, the reduced metal values may be melted, permitting the inert particles to physically separate. Standard mechanical techniques may also be employed.

One particular embodiment of the process of the present invention concerns the reduction of cuprous chloride to elemental copper by means of hydrogen reduction in a fluidized bed reactor. The reduced copper has a high tendency to sinter in such a reaction to the extent that a fluidized bed cannot be maintained. The FIGURE illustrates a general process flow diagram for this particular embodiment. Ottawa sand is illustrated as the preferred type of particles employed to restrain sintering.

Referring to the FIGURE, it is observed that the cuprous chloride feed material is mixed with the sand in a ratio as hereinabove described. This combination is then injected into the reactor at a point near the bottom of the reactor. A mixture of gas and nitrogen is injected into the bottom of the reactor and dispersed through a diffusion plate under sufficient pressure to produce a velocity sufficient to maintain the fluidized nature of the bed. Hydrogen is preferably employed in at least about the stoichiometric amount required, more preferably from about 120% to about 300%, and most preferably from about 150% to about 200% of the stoichiometric amount required to insure complete reduction of the cuprous chloride. Excess hydrogen is recovered and recycled, hence employment of such an excess does not present a waste problem.

The process is conducted in a continuous fashion, with the products being continuously recovered. As is illustrated in the FIGURE, the overhead stream from the reactor comprises hydrogen chloride and unreacted fluidizing gases, and this mixture is scrubbed to separate the hydrogen chloride from the fluidizing gases. The unreacted fluidizing gases are recovered and recycled, while the separated hydrogen chloride solution is used to cleanses and particles of any copper which may have reduced on them. Copper agglomerates, with some entrained sand, are continuously recovered from the reactor and sent to the product separation stage. In the product separation stage the sand is removed from the elemental copper, cleansed with hydrogen chloride to produce cuprous chloride, hydrogen and clean sand; and each of these products is recycled to the initial stages of the process. The resulting elemental copper can then be refined and cast as desired.

The temperature of the reaction is preferably maintained from about 200° to about 1,000°, more preferably from about 400° to about 600°, and most preferably from about 450° to about 550° C. If the reaction temperature is too low, the rate of reaction decreases. If the reaction exceeds about 600° C, a fraction of the cuprous chloride reactant tends to volatilize, resulting in the production of very fine copper. These fines are difficult to handle and separate from the fluidized gases.

The hydrogen fluidizing agent introduced into the reactor is preheated in order to maintain the desired temperature of reaction, and one source of preheat can be the reactor overhead product stream.

EXAMPLES

The following examples were carried out in a continuous 4-inch fluidized bed reactor equipped with a hydrogen gas scrubbing and recycle system, and in each example cuprous chloride was the feed material. The fluidizing gas consisted of preheated hydrogen which was injected into the reactor at the bottom of the bed through orifices in the diffusion plate.

EXAMPLE 1

Sodium chloride particles were mixed with the cuprous chloride and injected into the reactor, with the reaction temperature being maintained from about 520°-550° C. The cuprous chloride was not reduced, and further inspection showed the formation of a eutectic due to the chemical activity of sodium chloride. The fact that the particles must be chemically inert is thereby emphasized.

EXAMPLE 2

This test used silica sand particles in a ratio of two parts by weight sand to one part cuprous chloride feed. The particle size was minus 20 plus 48 mesh, the feed rate was about 5 grams per minute and the reactor space velocity was maintained at about 1.50 feet per second. The reaction temperature was about 440° C. The bed maintained fluidization throughout the reaction, and the product assayed 78.7% copper, indicating only a small amount of sand in the product stream.

EXAMPLE 3

This test was conducted the same as Example 2; however, the ratio of sand to cuprous chloride was changed to one part sand to two parts cuprous chloride. This ratio proved to be too low under these conditions, as the bed would not maintain a fluidized condition.

EXAMPLE 4

This test employed conditions similar to those of Example 2; however, the particle type was a crushed graphite of minus 20 plus 48 mesh. Copper uniformly reduced on the carbon, creating a sticky condition and causing the bed to defluidize. The carbon particles possessed an irregular surface area and were highly porous.

EXAMPLE 5

Magnesium oxide grains were used as a bed material for reducing the cuprous chloride, the mixture being one part cuprous chloride to two parts magnesium oxide. The reaction temperature was maintained at about 445° C, the test was run for 10 hours with a total of 920 grams of feed entering the reactor. Properly sized copper agglomerates were formed; however, some copper penetration of the magnesium oxide grains occurred.

EXAMPLE 6

This example employed conditions similar to those of Example 5; however, the particles were fused aluminum oxide. The test was run for 13.2 hours, and 1470 grams of feed entered the reactor. Good copper agglomerates were formed; however, a portion of the agglomerates contained some of the aluminum oxide.

EXAMPLE 7

Again, the conditions of Example 5 were repeated, with the particle type being a reduction grade alumina. The reactor temperature averaged about 450° C. The test was conducted for 12.4 hours and 1572 grams of feed entered the reactor. Relatively small copper agglomerates were formed, and some of these appeared to be based on the aluminum oxide substrates.

EXAMPLE 8

This example was also run in a manner similar to that of Example 5, with the average temperature being maintained at about 450° C, the test time being 12.2 hours and the feed containing 1652 grams of cuprous chloride. Periclase of a minus 20 plus 48 mesh were used as the particles. Copper agglomerates were formed, although the recovered product contained a substantial amount of magnesium oxide, causing a more difficult product separation problem.

As Examples 5 through 8 illustrate, particles other than sand are suitable as long as they substantially meet the requirements hereinabove set forth. However, as these particles increasingly vary from these requirements, the improvement in the reduction reaction decreases.

What is claimed is:

1. In a process for recovering elemental copper and copper-bearing materials selected from the group consisting of copper oxides and copper salts by means of reducing the copper-bearing materials with hydrogen in a fluidized bed reactor, the improvement comprising:

performing the reduction in the presence of sufficient chemically inert, relatively smooth, generally spherical particles in order to restrain sintering of the reduced copper.

2. The process of claim 1 wherein the copper-bearing material is cuprous chloride.

3. The process of claim 1 wherein the copper-bearing material is cupric chloride.

4. The process of claim 1 wherein the reaction temperature is maintained from about 400° C to about 600° C.

5. The process of claim 1 wherein the particles have a relatively low apparent porosity.

6. The process of claim 1 wherein the particles comprise sand.

7. The process of claim 1 wherein the melting point of the particles is greater than the maximum temperature in the reactor.

8. The process of claim 1 wherein the particles range in size from about 9 to about 150 mesh within a space velocity range of about 1 to about 5 feet per second.

9. The process of claim 1 wherein the amount of particles is from about 0.7 to about 10 times by weight of the amount of the feed material.

10. In a process for recovering elemental copper from copper-bearing materials selected from the group consisting of copper oxides and copper salts by means of reducing the copper-bearing materials with hydrogen in a fluidized bed reactor, the improvement comprising:

performing the reduction at a temperature of from about 400° C to about 600° C in the presence of from about 0.7 to about 10 times by weight based on the amount of copper-bearing feed material of particles ranging in size from about 9 to about 150 mesh, the particles being characterized as being chemically inert with respect to the reactants in the reactor, and having relatively smooth, generally spherical surface areas with relatively low apparent porosities in order to restrain sintering of the reduced copper.

11. The process of claim 10 wherein the copper-bearing feed material is cuprous chloride.

12. The process of claim 10 wherein the copper-bearing feed material is cupric chloride.

13. The process of claim 10 wherein the particles comprise sand.

14. In a process for recovering elemental copper from cuprous chloride by means of reducing the cuprous chloride with hydrogen in a fluidized bed reactor, the improvement comprising:

performing the reduction in the presence of from about 0.7 to about 10 times based on the weight of cuprous chloride feed material of sand ranging in size from about minus 20 to about plus 48 mesh, the sand particles possessing a relatively smooth surface area and being generally spherical in shape in order to restrain sintering of the reduced copper.

15. The process of claim 14 wherein the temperature of the reaction is maintained from about 400° C to about 600° C.

16. The process of claim 14 wherein the ratio based on weight of sand to cuprous chloride feed material is from about 1 to about 5.

17. The process of claim 14 wherein at least the stoichiometric amount of hydrogen is employed in the reduction process.

* * * * *

UNITED STATES PATENT OFFICE

CERTIFICATE OF CORRECTION

Patent No. 4,039,324 Dated August 2, 1977

Inventor(s) Frank M. Stephens, Jr. and James C. Blair

It is certified that error appears in the above-identified patent and that said Letters Patent are hereby corrected as shown below:

Column 5, line 6, "cleanses and" should read --cleanse the--.
In Claim 1, Column 6, line 56 "and" should read --from--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*